US006710336B2

(12) United States Patent
Wells

(10) Patent No.: US 6,710,336 B2
(45) Date of Patent: Mar. 23, 2004

(54) ION TRAP MASS SPECTROMETER USING PRE-CALCULATED WAVEFORMS FOR ION ISOLATION AND COLLISION INDUCED DISSOCIATION

(75) Inventor: Gregory J. Wells, Fairfield, CA (US)

(73) Assignee: Varian, Inc., Palo Alto, CA (US)

( * ) Notice: Subject to any disclaimer, the term of this patent is extended or adjusted under 35 U.S.C. 154(b) by 71 days.

(21) Appl. No.: 10/066,276

(22) Filed: Jan. 30, 2002

(65) Prior Publication Data

US 2003/0150988 A1 Aug. 14, 2003

(51) Int. Cl.[7] ..... H01J 49/42
(52) U.S. Cl. ..... 250/292
(58) Field of Search ..... 250/281–300, 250/424

(56) References Cited

U.S. PATENT DOCUMENTS

| | | | | |
|---|---|---|---|---|
| 4,736,101 A | | 4/1988 | Syka et al. | |
| 5,134,286 A | | 7/1992 | Kelley | |
| 5,198,665 A | | 3/1993 | Wells | |
| 5,302,826 A | * | 4/1994 | Wells | 250/292 |
| 5,324,939 A | | 6/1994 | Louris et al. | |
| 5,448,061 A | * | 9/1995 | Wells | 250/282 |
| 5,449,905 A | | 9/1995 | Hoekman et al. | |
| 5,521,380 A | * | 5/1996 | Wells et al. | 250/282 |
| 5,640,011 A | * | 6/1997 | Wells | 250/282 |
| 5,696,376 A | * | 12/1997 | Doroshenko et al. | 250/292 |
| 5,793,038 A | * | 8/1998 | Buttrill, Jr. | 250/282 |

FOREIGN PATENT DOCUMENTS

EP 0 575 778 A 12/1993

OTHER PUBLICATIONS

Shenheng G et al., entitled "Storged Waveform Inverse Fourier Transform (SWIFT) Ion Excitation in Trapped–Ion Mass Spectrometry: Theory and Applications" published by International Journal of Mass Specrometry and IOn Processes, 157/158 (1996). 5–37.

Article by Raymond March, entitled "An Introduction to Quadrupole Ion Trap Mass Spectrometry", published by Journal of Mass Spectrometry, vol. 32, pp. 351–369 (1997).

* cited by examiner

*Primary Examiner*—John R. Lee
*Assistant Examiner*—Christopher M. Kalivoda
(74) *Attorney, Agent, or Firm*—Bella Fishman; Edward H. Berkowitz

(57) ABSTRACT

In a quadrupole ion trap mass spectrometer, a library of optimized notched waveforms are pre-calculated, optimized and stored in a fast memory such as semiconductor RAM. Computer controlled apparatus selectively applies the pre-calculated waveforms to end caps of the quadrupole ion trap for isolating an ion with a specific mass to charge ratio. The pre-calculated waveforms are optimized notch waveforms with each waveform being pre-calculated for a specific mass. The memory further stores a library of single frequency CID waveforms for use in collision induced dissociation of an isolated ion. By providing the pre-calculated waveforms, a method is provided to isolate and dissociate a selected ion.

11 Claims, 2 Drawing Sheets

(PRIOR ART) FIG.1
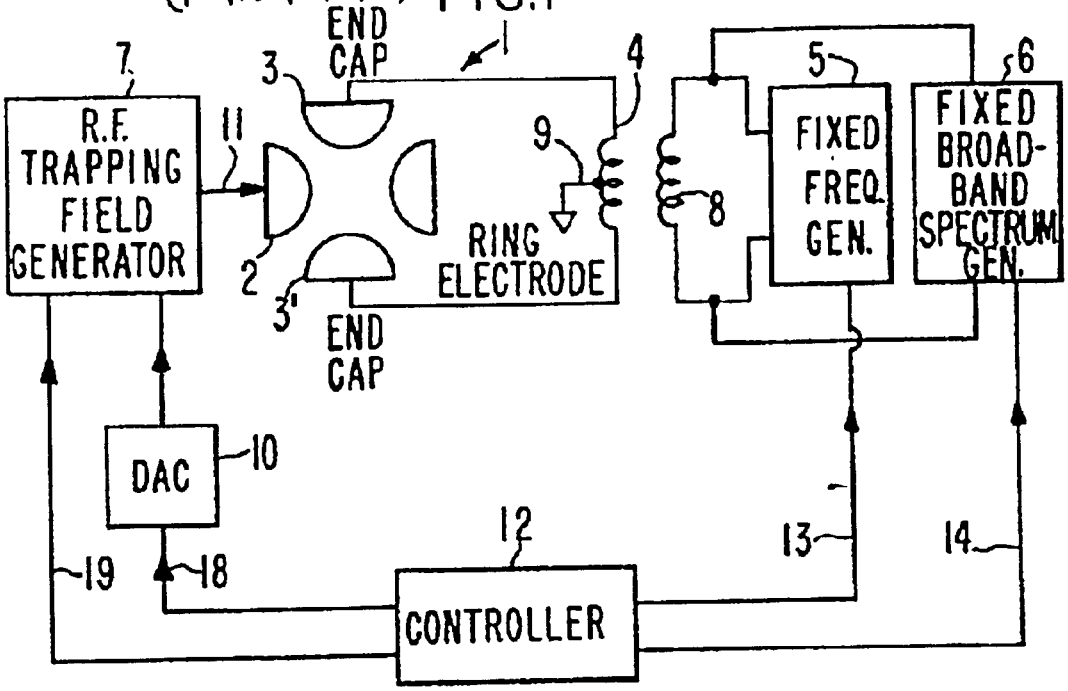
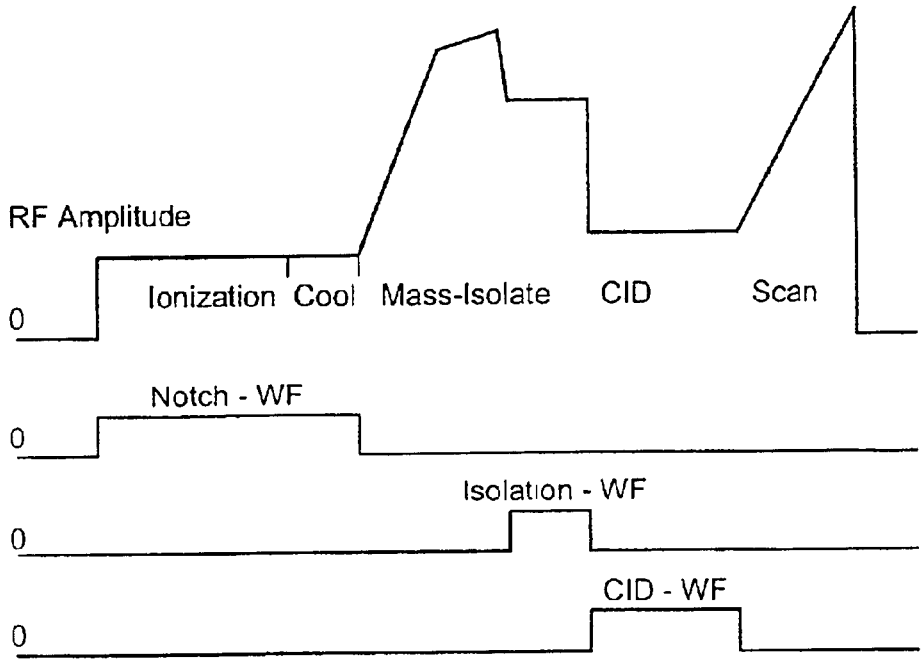
Figure 2

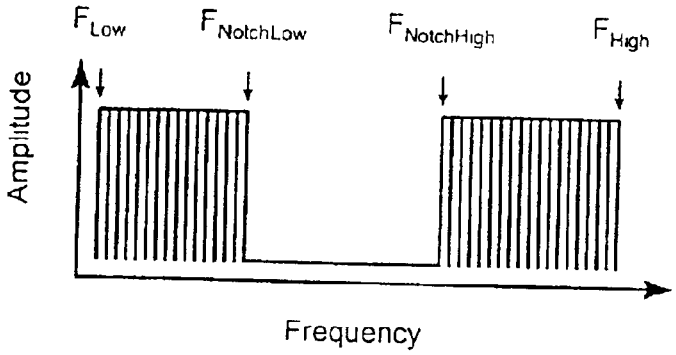
Figure 3
FIG4
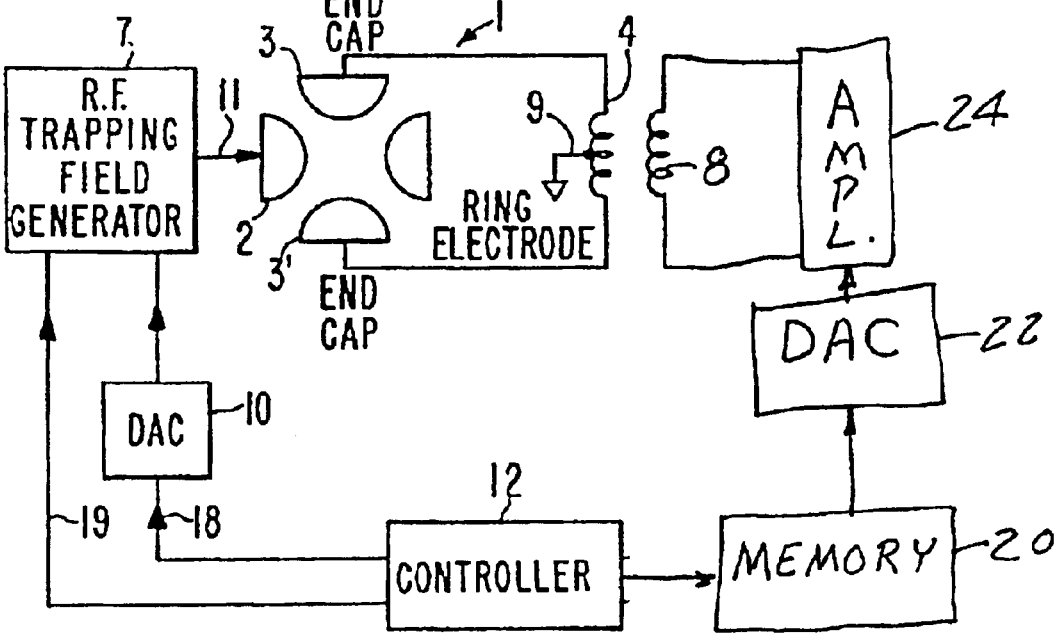

ION TRAP MASS SPECTROMETER USING PRE-CALCULATED WAVEFORMS FOR ION ISOLATION AND COLLISION INDUCED DISSOCIATION

BACKGROUND OF THE INVENTION

This invention relates generally to mass spectrometers, and more particularly the invention relates to ion traps for ion isolation and collision induced dissociation (CID) in mass spectrometers.

Mass spectrometers are well-known scientific instruments for analyzing chemical structures. A mass spectrometer includes an ion source, an ion filter, and an ion detector. Gas at low pressure is introduced into the ion source which ionizes the gas. Ions are then selected by the ion filter and passed to the ion detector. The ion filter selects ions having a particular m/e ratio which may be varied to analyze the gas.

U.S. Pat. No. 4,736,101 describes a quadrupole technique called MS/MS which includes the steps of forming and storing ions having a range of masses in an ion trap, mass selecting among them to select an ion of particular mass to be studied (parent ion), dissociating the parent ion by collisions, and analyzing or separating and ejecting the fragments (daughter ions) to obtain a mass spectrum of the daughter ions. To isolate an ion for purposes of MS/MS, a method of scanning or ramping up an RF trapping field voltage according to known equations ejects ions having atomic mass up to the m/e of the ion of interest. Then, the RF trapping field voltage is lowered and the ions remaining are dissociated by collision. Finally, the RF trapping voltage is scanned up again and a mass spectrogram of the ejected daughter ions is obtained. One technique of obtaining CID to obtain daughter ions is to employ a second fixed frequency generator connected to the endplates of the quadrupole ion trap which frequency is at the calculated secular frequency of the retained ion being investigated. The secular frequency is the frequency in which the ion is periodically, physically moving within the RF trapping field.

FIG. 1 illustrates a quadrupole ion trap as described in U.S. Pat. No. 5,198,665. The quadrupole ion trap 1 employs a ring electrode 2 of hyperbolic configuration which is connected to a radio frequency trapping field generator 7. A digital to analog converter (DAC) 10 is connected to the RF trapping field generator 7 for controlling the amplitude of the output voltage 11. Hyperbolic end caps 3 and 3' are connected to coil 4 of a coupling transformer 8 having a center tap 9 connected to ground. The transformer 8 secondary winding is connected to a fixed frequency generator 5 and to a fixed broadband spectrum generator 6. Controller 12 is connected to digital to analog converter (DAC) 10 via connector 18 and the three generators 5, 6 and 7 via connectors 13, 14 and 19 respectively, to manage the timing of the quadrupole ion trap sequences.

As described above, MS/MS procedures require two steps including (1) precursor mass isolation, and (2) collision induced dissociation or CID. Mass isolation is accomplished by the method illustrated in the waveforms of FIG. 2, which are described in detail in U.S. Pat. No. 5,198,665, supra, with the addition of a notched waveform as shown in FIG. 3 that is applied during the ionization step and for a short "cool time" after the end of ionization. Undesired ion masses are energized by the waveform and removed from the ion trap. However, the notch (i.e., a frequency range) in which there are no frequencies of significant intensity, does not energize the ions of interest which remain in the ion trap. After the unenergized ion is mass isolated, the RF trapping field is lowered to allow the trapping of product ions formed from CID, and a waveform is applied at the secular frequency of the ion to effect CID.

There are many ways of optimizing and phasing multifrequency notched waveforms that are known in the art. U.S. Pat. No. 5,324,939 requires calculation of the entire waveform. U.S. Pat. No. 5,449,905 calculates the frequencies within the notch of the waveform and are then subtracted from a waveform containing no notches. U.S. Pat. No. 5,134,286 filters a base broadband noise waveform to remove a selected range of frequencies. In all of these prior art methods multiple discrete frequencies have to be calculated and summed with the appropriate phasing and amplitude to produce the final waveform. Further, the intensity of each frequency component to be summed must be calculated at each data point comprising the waveform. For example, a multifrequency waveform having a frequency range from 5 kHz to 500 kHz requires 5,000 data points clocked out at 2.5 mHz. This represents 5 points per cycle at 500 kHz, which is sufficient to meet the Nyquist requirement to prevent frequency aliasing. A total of 990 frequencies, spaced 500 Hz apart, can be in this waveform. If an intensity at each data point must be calculated for each frequency component, then a total of 4,950,000 intensities must be calculated and appropriately summed to produce the final waveform. Each calculation is of the form of a trigonometric function, which converges slowly when digitally calculated.

SUMMARY OF THE INVENTION

The present invention provides an improved quadrupole ion trap in a mass spectrometer by including a library of optimized notched waveforms stored in computer memory which can be selectively accessed and applied to isolate desired ions for analysis. The library can include second waveforms for use in CID after the precursor mass is isolated.

The secular frequency of a particular ion can be adjusted to match the central frequency of a pre-calculated waveform by adjusting a trapping parameter, such as RF voltage amplitude.

Thus the apparatus and method in accordance with the invention can present the required conditions to isolate a specified ion mass and then cause CID without the need to recalculate the waveforms needed to effect ion mass isolation and CID.

The invention and objects and features thereof will be more readily apparent from the following detailed description and appended claims when taken with the drawings.

BRIEF DESCRIPTION OF THE DRAWINGS

FIG. 1 is a schematic of a quadrupole ion trap in accordance with the prior art.

FIG. 2 illustrates conventional steps in isolating and evaluating ions in a MS/MS system using the quadrupole ion trap of FIG. 1.

FIG. 3 illustrates a notched frequency waveform conventionally used in ion mass isolation in FIG. 2.

FIG. 4 illustrates a quadrupole ion trap in accordance with the present invention.

DETAILED DESCRIPTION OF THE INVENTION

The invention uses pre-calculated waveforms to isolate an ion with a specific mass to charge ratio and to cause collision induced dissociation (CID) for data dependent operation of an ion trap mass spectrometer. Data dependent operation of an ion trap mass spectrometer requires the recognition of a specific mass in the last sample acquired frequency spectrum, based on predefined criteria. If the mass is present and the criteria are met, then the next frequency scan automatically mass isolates the identified mass and causes CID to occur. This requires a very fast method to calculate all of the conditions to isolate and disassociate the ion, as provided with the invention.

FIG. 4 is a schematic of one embodiment of a quadrupole ion trap (QIT) in accordance with the invention. The QIT is similar to the QIT disclosed in U.S. Pat. No. 5,198,665, supra, and illustrated in FIG. 1. However, the fixed frequency generator 5 and broadband spectrum generator 6 are replaced by a memory 20 which stores a library of optimized notched waveforms, of a fixed notch width, which are pre-calculated, optimized and stored in a fast random access memory. The appropriate waveform for a specific mass to charge ratio ion is selected by controller 12 and applied through a digital to analog converter (DAC) 22 and amplifier 24 to drive coil 8 and coupled coil 4. If necessary, a trapping parameter, such as RF voltage amplitude, can be adjusted by controller 12, so that the secular frequency of a particular ion is adjusted to match the central frequency of a pre-calculated waveform. An increase in voltage increases the ion oscillation frequency, and a decrease in voltage decreases the ion oscillation frequency. Thus, interpolation between two pre-calculated values is accomplished by adjusting the RF trapping voltage amplitude.

Waveform techniques in general require the input of mass and RF storage voltage information (generally in mass units for the user interface), and the calculation of the resonant frequency of the ion. The calculation of any resonant frequency requires the knowledge of the ion mass and the RF storage voltage. The RF storage voltage is linearly related to the RF DAC value applied to the RF generator that generates the RF voltage, where DAC is the trapping field RF amplitude. The RF voltage ($V_{rf}$) is given by: $V_{rf}=s'(DAC)_m+b'$; where (s') and (b') are constants. The relationship between mass m, DAC and q (a trapping parameter) is given by: $q_m=[s(DAC)_m+b]/m$. Trapping parameter, q, is a function of trap geometry, operating frequency, voltage, and secular frequency. See, for example, March, "An Introduction to Quadruple Ion Trap Mass Spectrometry," Journal of Mass Spectrometry, Vol. 32, pp. 351–369 (1997). The slope (s) and offset (b) can be determined from an empirical frequency calculation. Thus, for the initial default choice of ionization storage RF $(DAC)_{mi}$ for mass (m), the initial (q) value is: $q_{mi}=[s(DAC)_{mi}+b]/m$. Since (q) is a monotonic function of frequency, the central frequency of each notch waveform in the waveform library could be indexed in terms of (q). The $q_{mi}$ value of the mass for the default storage RF DAC, is compared to the notched waveform library for the closest matching library waveform whose notch center frequency has the corresponding (q) value $q_{lib}$. The trapping field RF amplitude (i.e. DAC) is then adjusted to cause the ion secular frequency to match the library value at the notch center. This is equivalent to making the ion q value match the waveform q value at the notch center. The new DAC value is therefore: $q_{lib}=[s(DAC)_{mnew}+b]/m$ or $(DAC)_{mnew}=(mq_{lib}-b)/s$. The waveforms should typically have 500 Hz spacing and random, or other appropriate, phases. Since the number of frequencies will remain essentially constant and only the notch position moves, the optimum waveform amplitude can be kept constant, independent of mass or notch center frequency. A shift in the RF storage mass (i.e. RF voltage) of no more than +/−7% will allow the resonant frequency of any mass to match the center frequency of one of the library waveforms.

In Table 1 the waveform parameters shown in FIG. 3 are listed for each waveform in the library. The values $F_{NotchHigh}$ and $F_{NotchLow}$ correspond to the beginning and the end of the frequency notch. For example for a default RF storage voltage corresponding to a mass cut off of 40 Da (Dalton), the waveform library in Table 1 shows the notch center frequency for various masses. Mass 80 has a center frequency of 173.0 kHz and the corresponding waveform can be used to cover precursor masses in the range of 75 to 85 range by changing the nominal RF storage voltage of 40 Da by +/−7% to make the secular frequency of any masses within this range exactly match the center notch frequency of this one waveform.

TABLE 1

| | Waveform Library | | | | | | | |
|---|---|---|---|---|---|---|---|---|
| Precursor Mass | $F_{Center}$ (kHz) | $q_{center}$ | $F_{High}$ (kHz) | $F_{NotchHigh}$ (kHz) | $F_{NotchLow}$ (kHz) | $F_{Low}$ (kHz) | Final Notch Width (kHz) | Max Mass Window |
| 60 | 245.5 | 0.610 | 480 | 259.5 | 231.5 | 10 | 28 | 3 |
| 70 | 204.0 | 0.521 | 480 | 215.0 | 193.0 | 10 | 22 | 3 |
| 80 | 173.0 | 0.450 | 480 | 182.0 | 164.0 | 10 | 18 | 3 |
| 90 | 150.0 | 0.394 | 480 | 158.0 | 142.0 | 10 | 16 | 4 |
| 100 | 132.0 | 0.350 | 480 | 138.8 | 125.2 | 10 | 14 | 4 |
| 110 | 118.5 | 0.315 | 480 | 124.5 | 112.5 | 10 | 12 | 5 |
| 120 | 108.0 | 0.288 | 480 | 113.9 | 102.1 | 10 | 12 | 5 |
| 140 | 92.0 | 0.247 | 480 | 97.0 | 87.0 | 10 | 10 | 7 |
| 160 | 81.0 | 0.218 | 480 | 85.9 | 76.1 | 10 | 10 | 7 |
| 180 | 72.5 | 0.195 | 480 | 77.5 | 67.5 | 10 | 10 | 7 |
| 200 | 66.0 | 0.178 | 480 | 70.6 | 61.4 | 10 | 9 | 10 |
| 230 | 58.0 | 0.156 | 480 | 62.5 | 53.5 | 10 | 9 | 10 |
| 260 | 52.0 | 0.141 | 480 | 56.5 | 47.5 | 10 | 9 | 10 |
| 300 | 46.0 | 0.125 | 480 | 50.5 | 41.5 | 10 | 9 | 10 |
| 350 | 40.0 | 0.108 | 480 | 43.8 | 36.2 | 10 | 8 | 12 |
| 410 | 34.0 | 0.092 | 480 | 37.8 | 30.2 | 10 | 8 | 12 |
| 460 | 30.0 | 0.082 | 480 | 33.8 | 26.2 | 10 | 8 | 14 |
| 530 | 26.0 | 0.070 | 480 | 29.8 | 22.2 | 10 | 8 | 14 |
| 610 | 22.5 | 0.061 | 480 | 26.3 | 18.7 | 10 | 8 | 14 |
| 700 | 19.0 | 0.052 | 480 | 22.8 | 15.2 | 10 | 8 | 20 |
| 800 | 16.5 | 0.045 | 480 | 20.5 | 12.5 | 10 | 8 | 20 |

TABLE 1-continued

| Waveform Library | | | | | | | | |
|---|---|---|---|---|---|---|---|---|
| Precursor Mass | $F_{Center}$ (kHz) | $q_{center}$ | $F_{High}$ (kHz) | $F_{NotchHigh}$ (kHz) | $F_{NotchLow}$ (kHz) | $F_{Low}$ (kHz) | Final Notch Width (kHz) | Max Mass Window |
| 920 | 14.0 | 0.038 | 480 | 18.0 | 10.0 | 10 | 8 | 20 |
| 1000 | 12.5 | 0.034 | 480 | 16.5 | 8.5 | 10 | 8 | 20 |

After mass isolation the RF storage voltage is set to a default value. For the initial default choice of storage RF $(DAC)_{mi}$ for mass (m) the initial (q) value is: $q_{mi}=[s(DAC)_{mi}+b]/m$. Since (q) is a monotonic function of frequency, the CID frequency could be indexed in terms of (q). The $q_{mi}$ value of the mass for the default storage RF DAC, is compared to the index of the waveform library for the closest matching library waveform whose frequency has the corresponding (q) value $q_{lib}$. The trapping field RF amplitude (i.e. DAC) is then adjusted to cause the ion secular frequency to match the library value. This is equivalent to making the ion q value match the waveform q value. The new DAC value is therefore: $q_{lib}=[s(DAC)_{mnew}+b]/m$ or $(DAC)_{mnew}=(mq_{lib}-b)/s$. A waveform library of single frequency CID waveforms is therefore possible. A total of 44 waveforms would be required to span the entire CID frequency range.

TABLE 2 shows the value of the library waveform frequency ($f_{center}$) and the shift in frequency, $f_L$ to $f_H$ that can be obtained by changing the RF storage voltage by +/−5%. The change in the RF storage voltage can be effected by either changing the precursor mass or RF storage mass (i.e. RF storage DAC). The library in TABLE 2 will allow any presursor mass from 60–1000 to be placed at CID storage masses corresponding to 30 to 950. The use of libraries of multi-frequency waveforms is also possible if the number of frequency components is fixed. Note that the $F_L$ from one $F_{center}$ waveform frequency will overlap the $F_H$ from the next $F_{center}$ waveform frequency.

TABLE 2

| | Frequency (kHz) | | |
|---|---|---|---|
| Number | $f_L$ | $f_{center}$ | $f_H$ |
| 1 | 365.0 | 407.5 | 465.0 |
| 2 | 311.1 | 336.0 | 365.9 |
| 3 | 275.1 | 293.5 | 313.2 |
| 4 | 246.9 | 262.5 | 278.6 |
| 5 | 219.3 | 233.5 | 247.4 |
| 6 | 191.8 | 204.5 | 216.9 |
| 7 | 169.3 | 180.5 | 191.6 |
| 8 | 151.9 | 162.0 | 171.7 |
| 9 | 135.3 | 144.0 | 152.4 |
| 10 | 123.4 | 131.0 | 138.5 |
| 11 | 112.0 | 118.5 | 125.2 |
| 13 | 101.3 | 107.0 | 112.6 |
| 14 | 91.0 | 96.0 | 100.7 |
| 15 | 84.5 | 89.0 | 93.1 |
| 16 | 78.0 | 82.0 | 85.8 |
| 17 | 71.8 | 75.0 | 78.7 |
| 18 | 65.5 | 68.5 | 71.8 |
| 19 | 59.3 | 62.0 | 64.9 |
| 20 | 56.2 | 59.0 | 61.4 |
| 21 | 53.0 | 55.5 | 58.0 |
| 22 | 49.8 | 52.0 | 54.5 |
| 23 | 46.6 | 49.0 | 51.0 |
| 24 | 43.2 | 45.5 | 47.4 |
| 25 | 39.9 | 42.0 | 43.8 |
| 26 | 36.4 | 38.0 | 40.0 |

TABLE 2-continued

| | Frequency (kHz) | | |
|---|---|---|---|
| Number | $f_L$ | $f_{center}$ | $f_H$ |
| 27 | 32.8 | 34.5 | 36.2 |
| 28 | 29.2 | 31.0 | 32.3 |
| 29 | 27.3 | 29.0 | 30.2 |
| 30 | 25.4 | 27.0 | 28.2 |
| 31 | 23.4 | 25.0 | 26.1 |
| 32 | 21.4 | 23.0 | 23.9 |
| 33 | 19.4 | 20.5 | 21.7 |
| 34 | 17.3 | 18.5 | 19.5 |
| 35 | 15.2 | 16.0 | 17.2 |
| 36 | 13.5 | 14.5 | 15.4 |
| 37 | 11.8 | 12.5 | 13.5 |
| 38 | 10.0 | 11.0 | 11.5 |
| 39 | 9.1 | 10.0 | 10.6 |
| 40 | 8.2 | 9.0 | 9.6 |
| 41 | 7.3 | 8.0 | 8.6 |
| 42 | 6.4 | 7.0 | 7.6 |
| 43 | 5.4 | 6.0 | 6.6 |
| 44 | 4.5 | 5.0 | 5.5 |

There has been described a fast method and apparatus to obtain the required conditions to isolate a specified mass and cause CID in a mass spectrometer without the need to recalculate the waveforms needed to effect mass isolation and CID. While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. A quadrupole ion trap for use in a mass spectrometer comprising:

a) a ring electrode, b) a pair of end caps, c) an RF trapping voltage source for applying a trapping voltage to the ring electrode, and d) computer controlled apparatus for selectively applying pre-calculated waveforms to the end caps for isolating an ion with a specific mass to charge ratio, said computer controlled apparatus comprising a memory for storing a library of optimized notched waveforms, each said waveform being ore-calculated for a specific mass and wherein the memory further comprises a library of single frequency CID waveforms for use in collision induced dissociation of an isolated ion.

2. The quadrupole ion trap as defined by claim 1, wherein the computer controlled apparatus further comprises a digital to analog converter for converting digital data from the memory to an analog signal, and an amplifier for amplification of the analog signal.

3. The quadrupole ion trap as defined by claim 1, and further comprising a trapping parameter adjusting means for matching secular frequency of a particular ion to a central frequency of the pre-calculated waveform.

4. The quadrupole ion trap as defined by claim 3, wherein the trapping parameter adjusting means adjusts amplitude of the trapping voltage.

5. In a quadrupole ion trap mass spectrometer having a ring electrode, a pair of end caps, an RF trapping generator, the improvement comprising:

computer controlled apparatus for selectively applying pre-calculated waveforms to the end caps for isolating an ion with a specific mass to charge ratio, said computer controlled apparatus includes a memory for storing a library of optimized notched waveforms, each said waveform being pre-calculated for a specific mass and wherein the memory further comprises a library of single frequency CID waveforms for use in collision induced dissociation of an isolated ion.

6. The improvement as defined by claim 5, wherein the computer controlled apparatus further comprises a trapping parameter adjusting means for matching secular frequency of a particular ion to a central frequency of the pre-calculated waveform.

7. The improvement as defined by claim 6, wherein the trapping parameter is an amplitude of a RF trapping voltage.

8. In a method of isolating a selected parent ion having a mass, M, for MS/MS spectrometry employing a quadrupole ion trap (QIT), said QIT having a ring electrode, a pair end caps, an RF trapping voltage source for applying the trapping voltage to the ring electrode, and an RF voltage source connected to the end caps, said method including the steps of:

storing pre-calculated waveforms for isolating ions of specific mass to charge ratios, and providing a computer controlled memory for storing a library of digitally defined optimized notched waveforms, each said waveform being pre-calculated for a specific mass, and further including storing a library of single frequency CID waveforms for use in collision induced dissociation of an isolated ion b) selectively applying a pre-calculated waveform to the end caps for isolating an ion with specific mass to charge ratio.

9. The method as defined by claim 8, wherein step b) includes providing a digital to analog converter for converting digital data from the memory to an analog signal, and an amplifier for the analog signal.

10. The method as defined by claim 8, further including the step of:

adjusting a trapping parameter for matching secular frequency of a particular ion to a central frequency of the pre-calculated waveform.

11. The method as defined by claim 10, wherein the trapping parameter is RF trapping voltage amplitude.

* * * * *